US006372401B1

(12) United States Patent
Matsuzaki et al.

(10) Patent No.: US 6,372,401 B1
(45) Date of Patent: Apr. 16, 2002

(54) CARRIER FOR ELECTROPHOTOGRAPHY, METHOD FOR PRODUCING THE SAME CARRIER, AND DEVELOPING AGENT FOR ELECTROPHOTOGRAPHY USING SAME

(75) Inventors: Shigeo Matsuzaki; Kunitoshi Imura; Kouichi Matono, all of Sodegaura (JP)

(73) Assignees: Idemitsu Kosan Co., Ltd., Tokyo (JP); Kyocera Corporation, Kyoto (JP)

( * ) Notice: Subject to any disclaimer, the term of this patent is extended or adjusted under 35 U.S.C. 154(b) by 0 days.

(21) Appl. No.: 09/514,275

(22) Filed: Feb. 28, 2000

Related U.S. Application Data

(63) Continuation-in-part of application No. 09/117,048, filed as application No. PCT/JP97/00115 on Jan. 21, 1997, now abandoned.

(30) Foreign Application Priority Data

Jan. 25, 1996 (JP) ..... 8-010600

(51) Int. Cl.[7] ..... G03G 9/113
(52) U.S. Cl. ..... 430/111.35; 430/137.13
(58) Field of Search ..... 430/108, 106.6, 430/137.13, 111.35

(56) References Cited

U.S. PATENT DOCUMENTS

| | | | | |
|---|---|---|---|---|
| 4,564,647 A | | 1/1986 | Hayashi et al. | |
| 4,965,159 A | | 10/1990 | Kohno et al. | |
| 5,093,201 A | | 3/1992 | Ohtani et al. | |
| 5,166,027 A | | 11/1992 | Machida et al. | |
| 5,252,398 A | | 10/1993 | Ohtani et al. | |
| 5,272,037 A | | 12/1993 | Ohtani et al. | |
| 5,427,884 A | | 6/1995 | Ohtani et al. | |
| 5,919,593 A | | 7/1999 | Karima et al. | |
| 5,968,699 A | | 10/1999 | Matsuzaki et al. | |
| 5,998,076 A | * | 12/1999 | Mahabadi et al. | 430/106.6 |
| 6,197,465 B1 | * | 3/2001 | Matsuzaki et al. | 430/106.6 |

FOREIGN PATENT DOCUMENTS

| | | |
|---|---|---|
| DE | 15 97 888 | 9/1970 |
| DE | 37 14 010 | 11/1987 |
| DE | 38 25 954 | 2/1989 |
| DE | 39 26 029 | 2/1990 |
| EP | 0 441 127 | 8/1991 |
| EP | 001016933 A2 * | 7/2000 |
| JP | 60-106808 | 6/1985 |
| JP | 2-210365 | 8/1990 |
| JP | 5-181320 | 7/1993 |
| JP | 6-266168 | 9/1994 |
| JP | 8-044117 | 2/1996 |
| JP | 8-248689 | 9/1996 |
| JP | 9-204075 | 8/1997 |

OTHER PUBLICATIONS

English machine translation of JP 8–44117, Feb. 1996.*

Arthur S. Diamond (Ed.), Handbook of Imaging Materials, Marcel Dekker, Inc., pp. 214–215.

Patent Abstracts of Japan, vol. 14, No. 258 (P–1055), Jun. 4, 1990, JP 02–069770, Mar. 8, 1990.

* cited by examiner

*Primary Examiner*—Christopher Rodee
(74) *Attorney, Agent, or Firm*—Oblon, Spivak, McClelland, Maier & Neustadt, P.C.

(57) ABSTRACT

Disclosed are a carrier for electrophotography, a method for producing the same carrier, and a developing agent using the same. The carrier includes a carrier core material with magnetism and a high-molecular-weight polyethylene resin that coats the surface of the carrier core material, wherein the surface of the high-molecular-weight polyethylene resin coating the surface of the carrier core material is coated with a resin layer having an ability to control an electric charge and a thickness of 0.01–2 $\mu$m or with a particle layer having an ability to control an electric charge and a thickness of 0.01–2 $\mu$m.

The carrier for electrophotography and the developing agent using the same allow free control of its electrification polarity and free adjustment of the amount of electrification, taking advantage of excellent properties of the carrier having a polyolefin-based resin coat.

16 Claims, 7 Drawing Sheets

CARRIER FOR ELECTROPHOTOGRAPHY, METHOD FOR PRODUCING THE SAME CARRIER, AND DEVELOPING AGENT FOR ELECTROPHOTOGRAPHY USING SAME

This application is a Continuation-in-part (CIP) of application Ser. No. 09/117,048 Filed on Jul. 27, 1998, Abandoned which was originally filed as International Application Number PCT/JP97/00115 on Jan. 21, 1997.

TECHNICAL FIELD

The present invention relates generally to a carrier for electrophotography, a method for producing the same carrier, and a developing agent for electrophotography using the same. More particularly, it relates to a carrier for electrophotography used in development of an electrostatic latent image in an image formation method utilizing electrophotography, a method for producing the same carrier, and to a developing agent for electrophotography using the same.

BACKGROUND Art

Hitherto known as an electrostatic latent image development method for electrophotography is a two-component developing method, which allows frictional electrification of a toner, transportation of a developing agent, contact with an electrostatic latent image, and development by mixing an insulating non-magnetic toner and magnetic carrier particles together.

The particulate carrier used in such two-component developing method is usually produced by coating a magnetic carrier core material with an appropriate material in order to prevent filming a toner onto the surface of the carrier, to form a uniform surface of the carrier, to elongate the lifetime of the developing agent, to prevent damage or friction by a carrier of a photoconductor (sensitizer), and to control electrification polarity or amount of electrification, and for other purposes.

Conventional resin-coated carriers are not, however, satisfactory in durability because the coat is easily exfoliated (delaminated) by shock or other reasons such as stirring applied when used.

For example, in Japanese Patent Laid-open Nos. Sho 64-33562 and Sho 64-33563, carriers for developing electrostatic image, which comprises a core material provided thereon in order by using a supiller coater, an intermediate resin layer containing a styrene resin, a polyolefinic resin and the like, and a layer for controlling triboelectric chargeability containing a fluorinated alkyl (meth)acrylate. However, the delamination easily occurs between the intermediate resin layer and the layer for controlling triboelectric chargeability. Also, when the polyolefinic resin is used as the material for the intermediate resin layer, it is difficult to form firmly on the surface of the core material by using a supiller coater. Therefor, the delamination easily occurs between the intermediate resin layer and the surface of a core material particle, too.

To solve this problem, the applicants have developed and proposed a method to form a polyolefin-based resin coat by directly carrying out polymerization of an polyolefin-based monomer on carrier core material particles of ferrite or other materials as described e.g. in Japanese Patent Laid-open No. Hei2-187771. A polyolefin-based resin-coated carrier obtained by this methods has the strong adhesion between a core material particle and a polyolefin-based coated resin layer. This is because the polyolefin-based resin layer is formed by directly polymerization method on the surface of a core material particle which is porous, and a part of such layer penetrates into the core material as shown in FIGS. 8–11. Also, the polyolefin-based resin-coated carrier does not give any deterioration in the quality of image, and is excellent in durability and spent-resistance even if copying is repeated continuously for a long time.

Here, FIGS. 8 and 9 respectively show the sectional photo-views of a covering layer of carrier A which magnetic carrier core material is eliminated and which is encapsulated with an epoxy resin under the reduced pressure condition in order to observe by using a Scanning Electron Microscope (hereinafter SEM). Thus, the inside part of the covering layer which correspond to the magnetic carrier core material was filled with an epoxy resin.

FIGS. 10 and 11 similarly show the sectional photo-views of a covering layer of carrier A which core material particle is eliminated and which is encapsulated with an epoxy resin in order to observe by using a SEM. However, such encapsulation was carried out at the normal pressure condition, not the reduced pressure condition. Thus, the inside part of the covering layer which correspond to the magnetic carrier core was not filled with an epoxy resin.

On the other hand, however, this polyolefin-based resin-coated carrier is not adequately satisfactory with respect to free controllability of the electrification polarity or the amount of electrification.

Therefore, a polyolefin-based resin-coated carrier having a covering layer which is formed by directly polymerization method in the condition that a particle having an ability to control electric charge is added, have been proposed in Japanese Patent Laid-open No. Hei 3-208060. However, there is a problem that the particle having an ability to control an electric charge in the direct polymerization, remarkably reduces the polymerization activity of a catalyst and the forming of the covering layer is inhibited. Also, even if the direct polymerization is carried out in the low concentration of the particles having an ability to control an electric charge, they are not dispersed uniformly on the surface of the carrier and the controlling ability of the electric charge is quite low. Moreover, there is a problem that the controlling ability of the electric charge is greatly varied after using for a long time.

On the contrary, a carrier having a polyethylene type covering layer which is formed by directly polymerization and in which a particle having an ability to control an electric charge is added onto the uneven surface by a supiller boater, have been proposed in Japanese Patent Laid-open No. Hei 6-266168. However, a particle having an ability to control an electric charge is easily dropped off from the surface of the covering layer since it is not fixed to the surface. Also, the controlling ability of the electric charge is low since a thickness of the particle layer having an ability to control an electric charge is not adequate.

This invention addresses to the above-mentioned problems, i.e. the purpose of the present invention is to provide a carrier for electrophotography, a method for producing the same carrier and a developing agent for electrophotography using the carrier, which allows free control of the electrification polarity and the amount of electrification, taking advantage of an excellent property of the carrier having a polyethylene resin covering layer.

DISCLOSURE OF THE INVENTION

In order to achieve the above-mentioned purpose, namely, to have a free control ability (electrostatic charging ability)

of the electric charge polarity or the amount of electrification an excellent durability, as well as an excellent durability, the present invention provides a carrier for electrophotography having the following features as gists, a method for producing the same carrier, and a developing agent for electrophotography using the carrier.

[1] A carrier for electrophotography having a magnetic carrier core material and a polyethylene covering layer composed of a polyethylene resin having a weight-average molecular weight of 50,000 or more, wherein the polyethylene covering layer is a layer formed by directly polymerizing an ethylene monomer on the surface of the catalytic treated carrier core material and a particle layer having an ability to control an electric charge and having a thickness of 0.01–2 $\mu$m, is formed on the surface of the polyethylene covering layer.

[2] The above carrier for electrophotography, wherein the particle having an ability to control an electric charge is fixed onto the polyethylene resin layer by a mechanical impact or a thermal fixation with heating.

[3] The above carrier for electrophotography, wherein an electroconductive layer is formed onto the surface of said carrier core material prior to forming the polyethylene covering layer.

[4] The above carrier for electrophotography, wherein the electroconductive layer is a layer formed by directly polymerizing method.

[5] A carrier for electrophotography having a magnetic carrier core material and a polyethylene covering layer composed of a polyethylene resin having a weight-average molecular weight of 50,000 or more, wherein the polyethylene covering layer is a layer formed by directly polymerizing an ethylene monomer on the surface of the catalytic treated carrier core material and a resin layer having an ability to control an electric charge and having a thickness of 0.01–2 $\mu$m, is formed on the surface of the polyethylene covering layer and a part of the layer penetrates into the polyethylene covering layer.

[6] The above carrier for electrophotography, wherein an electroconductive layer is a layer formed onto the surface of said carrier core material prior to forming a polyethylene covering layer.

[7] The above carrier for electrophotography, wherein the electroconductive layer is a layer formed by directly polymerizing method.

[8] A method for producing a carrier for electrophotography having a magnetic carrier core material and a polyethylene covering layer composed of a polyethylene resin having a weight-average molecular weight of 50,000 or more, comprises a step for forming the polyethylene covering layer by directly polymerizing an ethylene monomer on the surface of the catalytic treated carrier core material, a step for attaching a particle having an ability to control an electric charge to the surface of the polyethylene covering layer, and a step for forming a particle layer having an ability to control an electric charge and having a thickness of 0.01–2 $\mu$m by a mechanical impact or a thermal fixation with heating.

[9] The method for producing the above carrier, further comprises a step for forming an electroconductive layer onto the surface of said carrier core material prior to forming a polyethylene covering layer.

[10] The method for producing the above carrier, further comprises a step for forming an electroconductive layer by directly polymerizing method.

[11] A method for producing a carrier for electrophotography having a magnetic carrier core material and a polyethylene covering layer composed of a polyethylene resin having a weight-average molecular weight of 50,000 or more, comprises a step for forming the polyethylene covering layer having an uneven surface by directly polymerizing an ethylene monomer on the surface of the catalytic treated carrier core material, a step for coating a solution including a resin having an ability to control an electric charge onto the surface of the polyethylene covering layer by using a wet-treatment, and a step for forming a resin layer having an ability to control an electric charge and having a thickness of 0.01–2 $\mu$m in the manner that a part of a resin layer penetrates the polyethylene covering layer by heating.

[12] The method for producing the above carrier, further comprises a step for forming an electroconductive layer onto the surface of said carrier core material prior to forming a polyethylene covering layer.

[13] The method for producing the above carrier, further comprises a step for forming an electroconductive layer by directly polymerizing method.

[14] A developing agent for electrophotography comprising the above-mentioned [1] or [5] carrier for electrophotography, and a toner mixed with said carrier at a ratio of 2–20 wt. %.

BEST MODE FOR CARRYING OUT THE INVENTION

Figure 1:
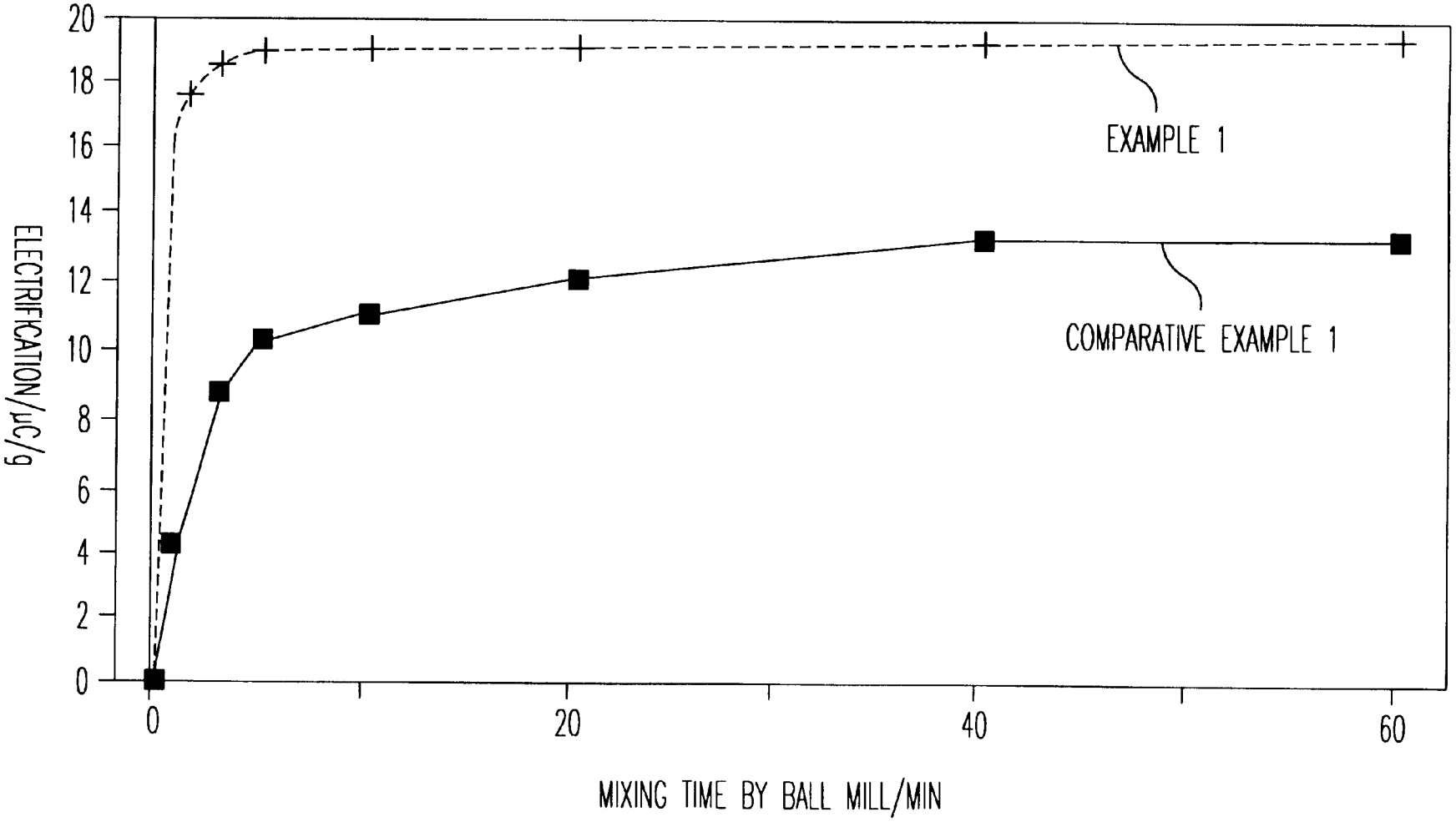
FIG. 1 illustrates comparative profiles of change of the amount of electrification by control of the amount of electrification of developing agents using carriers of Example 1 and Comparative Example 1 and both using the toner A.

The best mode for carrying out the invention will now be described.

I. Carrier for Electrophotography

The carrier for electrophotography according to the present invention has a carrier core material and a high-molecular-weight polyethylene resin layer which is for coating the surface of the carrier core material (a polyethylene covering layer), wherein a resin layer or a particle layer having an ability to control an electric charge of a predetermined thickness is formed on the surface of the polyethylene covering layer.

1. Carrier Core Material (1) Material

There is no special limitation for the core material of carrier according to the present invention. Well known materials for the two component-based carrier for electrophotography will be used such as;

1) a ferrite, a magnetite, or the like; metals such as iron, nickel, and cobalt,
2) an alloy or a mixture of these metals with a metal such as copper, zinc, antimony, aluminum, lead, tin, bismuth, beryllium, manganese, magnesium, selenium, tungsten, zirconium, and vanadium,
3) a mixture of the above-mentioned ferrite or the like with a metal oxide such as iron oxide, titanium oxide, and magnesium oxide, a nitride such as chromium nitride and vanadium nitride; a carbide such as silicon carbide and tungsten carbide,
4) a ferromagnetic ferrite, and
5) a mixture of these.

(2) Form and Particle Size

There is no special limitation for the form of the carrier core material. Both spherical and irregular forms are acceptable. Concerning the particle size of the carrier core material, its size of 20–100 $\mu$m are preferable. If the particles are smaller than 20 $\mu$m, attachment (scattering) of the carrier to the electrostatic latent image carrier (a photo-conductor in general) may occur. If the particles are larger than 100 $\mu$m, the carrier streaks may occur and cause the deterioration of the quality of the image.

(3) Weight ratio

The weight ratio of the carrier core material per the overall carrier is set 90 wt % or more, preferably 95% or more. If such ratio is less than 90 wt %, the coated layer may become too thick. Also, there is the possibility that the durability and the stability of electrification which are required for the developing agent may not be satisfied because of exfoliation of the coated layer, increase in the amount of electrification, and other troubles when the carrier is practically applied to the developing agent. Moreover, it may cause low reproducibility in fine lines, decrease in image density, and other troubles concerning the quality of image.

Concerning the upper limits of the weight ratio of the carrier core material, such a ratio may be enough that the coated resin layer can coat the surface of the carrier core material completely. This value depends on the physical property of the carrier core material and the method for coating.

(4) Electroconductive Layer

An electroconductive layer will be formed on the carrier core material particles prior to forming a polyethylene covering layer if necessary.

As the electroconductive layer formed on the carrier core material particles, e.g. an electroconductive layer in which electroconductive particles are dispersed in an appropriate binding resin will be used. The formation of such an electroconductive layer is effective in enhancing a developing property and giving clear images having high image density and clear contrast. The reason for this is considered that the existence of the electroconductive layer lowers electroresistance of the carrier to a suitable level to balance the leak and the accumulation of electric charge.

As the electroconductive particle added to the electroconductive layer, the followings will be favorably used: a carbon black such as a carbon black and an acetylene black, carbide such as SiC, a magnetic powder such as magnetite, $SnO_2$, and a titanium black. As the binding resin of the electroconductive layer, the followings will be used: various thermoplastic resins and thermosetting resins such as polystyrene-based resins, poly(metha) acrylic acid-based resins, polyolefin-based resins, polyamide-based resins, polycarbonate-based resins, polyether-based resins, polysulfonic acid-based resins, polyester-based resins, epoxy-based resins, polybutyral-based resins, urea-based resins, urethane/urea-based resins, silicon-based resins, and Teflon-based resins, and a mixture, a copolymer, a block polymer, a graft polymer, and a polymer blend of these resins.

The electroconductive layer will be formed by coating a liquid in which the above-mentioned electroconductive particles are dispersed in the appropriate binding resin onto the surface of the carrier core material particles by the spray coating method, the dipping method, and the like. Such a layer may also be formed by melting/blending/crushing the core material particles, electroconductive particles and a binding resin.

The electroconductive layer, however, may be preferably formed by directly polymerizing a polymerizable monomer on the surface of the core material particles in the presence of the electroconductive particles. When formed in such a manner, the electroconductive layer will have a surface having convexes and concaves (uneven surface) so that a surface-polymerizable catalyst will be maintained thereon. Thus, a covering layer with an improved contacting property can be formed by directly polymerizing a monomer on the surface of an electroconductive layer.

The size and addition amount of the above-mentioned electroconductive particles should satisfy the properties of the carrier according to the present invention finally. An average particle size that allows homogeneous dispersion in the above-mentioned resin solution of 0.01–2 $\mu$m, preferably 0.01–1 $\mu$m may be acceptable. The amount of the electroconductive particles to be added also depends on the kind or other factors and it is not possible to specify it. Addition by 0.1–60 wt. % to the binding resin of the electroconductive layer, preferably 0.1–40 wt. % may be acceptable. Although such a trouble occurs that the reproducibility decreases when fine lines are copied repeatedly using such a carrier when the packing ratio of the carrier is as small as about 90 wt. % and the thickness of the coated layer is relatively thick, this kind of problem will be efficiently dissolved by adding the above-mentioned electroconductive particles.

The carrier core material particles on which a functional layer such as an electroconductive layer is formed will be called hereafter also simply as "carrier core material particles" as long as misunderstanding can be avoided.

2. High-molecular-weight Polyethylene Resin (1) Kind

High-molecular-weight polyethylene resins, which are usually called "polyethylene", having a number-average molecular weight of10,000 or more, or a weight-average molecular weight of 50,000 or more are preferably used in the present invention. The followings having a number-average molecular weight lower than 10,000 are excluded from the high-molecular-weight polyethylene resins for the present invention: polyethylene wax (Mitsui High Wax, Mitsui Petrochemical Industries, Ltd.), Dialene 30 (Mitsubishi Gas Chemical Co., Ltd.), Nisseki Lexpole (Nippon Oil Co., Ltd.), San Wax (Sanyo Chemical Industries, Ltd.), Polyrets (Neutral Wax, Polymer Co., Ltd.), Neowax (Yasuhara Chemical. Co., Ltd.), AC Polyethylene (Allied Chemical. Inc.), Eporene (Eastman Kodak Corp.), Hoechst Wax (Hoechst Corp.), A-Wax (BASF Corp.), Polywax (Petrolite Co.,Ltd.), Escomer (Exxon Chemical. Co., Ltd), or the like. Although the polyethylene wax is coated by the usual dipping method and the usual spray method by dissolving in hot toluene or the like, the mechanical strength of the resin is weak and the resin is exfoliated by the shear or the like in a developing machine after a long-term use.

It is also possible to control the property by adding at least one kind of functional particles such as the above-mentioned electroconductive particles and particles having an ability to control the electric charge into the above-mentioned high-molecular-weight polyethylene resin coat.

(2) Method for Coating Resin

The following directly polymerization method is preferred to form a polyethylene covering layer. This is because that a part of a polyethylene covering layer penetrates into the porous core material and the strong adhesion can be obtained between the core material particle and a polyethylene covering layer. Therefore, thus obtained carrier does not give any deterioration in the quality of image, and is excellent in durability and spent-resistance even if copying is repeated continuously for a long time.

Here, "The directly polymerization method" is a method to produce a polyethylene resin-coated carrier by treating the surface of the carrier core material with an ethylene-polymerizing catalyst and directly polymerizing ethylene monomer (forming polyethylene) on the surface, as described e.g. in Japanese Patent Laid-open Nos. Sho 60-106808and Hei2-187770.

The polyethylene covering layer will be formed by suspending 1) a product that is formed in advance by contacting a highly active catalytic component that contains titanium and/or zirconium and is soluble in a hydrocarbon solvent such as hexane and heptane with the carrier core material, and 2) organoaluminum compound in the above-mentioned hydrocarbon solvent, supplying an ethylene monomer, and polymerizing it on the surface of the carrier core material. In the case particles or electroconductive particles having the above-mentioned an electric charge-conferring function are added, they will be added when the above-mentioned high-molecular-weight polyethylene resin-coated layer is formed.

As this production forms a polyethylene-coated layer directly on the surface of the carrier core material, a coat having an excellent strength and durability is obtained.

If functional particles such as electroconductive particles are dispersed/coexisted in the polymerization system like this, while a high-molecular-weight polyethylene resin coat is growing/being formed by polymerization, the functional particles are incorporated into this coat and a high-molecular-weight polyethylene resin coat containing the functional particles is formed.

Also, it is preferable that the ratio of carrier core material particle/high-molecular-weight polyethylene resin coat is preferably 99/1-90/10 by weight, more preferably 99/1-95/5 by weight.

Moreover, it is possible to add/carry at least one kind of functional particles such as particles having an ability to control the electric charge into the high-molecular-weight polyethylene resin coat to improve its quality. All the conventional well-known electroconductive particle such as carbide such as the above-mentioned carbon black and SiC, the electroconductive magnetic particles such as magnetite, $SnO_2$, titanium black, or the like can be used as the electroconductive particle which are carried in the high-molecular-weight polyethylene resin coat. The average size of the electroconductive particle is preferably within the range of 0.01–5.0 $\mu$m.

3. Electric Charge-Controlling Resin and Particle (1) Electric charge-controlling resin In the case the amount of electrification in a high-molecular-weight polyethylene resin-coated carrier is lower or higher than various toners (positively charged toner or negatively charged toner), a resin selected from the group A and the group B below is added/coated depending on the purpose.

Group A

- Fluorine-based resin (such as fluorovinylidene resin, tetrafluoroethylene resin, trifluorochloroethylene resin, and tetrafluoroethylene/hexafluoroethylene copolymer resin),
- Vinyl chloride-based resin, and
- Celluloid Group B

- Acryl resin,
- Polyamide-based resin (such as nylon-6, nylon-66, and nylon-11),
- Styrene-based resin (polystylene, ABS(Acrylonitrile-Butadiene-Styrene), AS (Acrylonitrile-Styrene, and AAS(Acrylonitrile-Styrene-Acrylate),
- Chlorovinylidene resin,
- Polyester-based resin (such as polyethylene terephthalate, polyethylene naphthalate, polybutylene terephthalate, polyacrylate, polyoxybenzoyl, and polycarbonate),
- Polyether-based resin (such as polyacetal and polyphenylene ether), and
- Ethylene-based resin (such as EVE(Ethylene-Vinyl-Ether),
- EEA(Ethylene-EthylAcrylate), EAA(Ethylene-Acrylic Acid),
- EMAA(Ethylene-MethylAcrylate), EAAM((Ethylene-AcrylAmide), and EMMA((Ethylene-MethylMethacrylate).

More concretely,

When the amount of electrification of (+) toner is increased, a resin in the group A is used.

When the amount of electrification of (+) toner is decreased, a resin in the group B is used.

When the amount of electrification of (−) toner is increased, a resin in the group B is used.

When the amount of electrification of (−) toner is decreased, a resin in the group A is used.

(2) Electric charge-controlling particle

In case the amount of electrification in a high-molecular-weight polyethylene resin-coated carrier is lower or higher than various toners (positively electrified toner or negatively electrified toner), electric charge-controlling particles (agent) selected from the group A and the group B below is added depending on the purpose.

Group A

- Salicylic acid-metal complex-based one, such as BONTRON E-48 and BONTRON E-88 (both Orient Chem. Ind. Co., Ltd.)
- Phenol-based condensate, such as BONTRON E-89 and BONTRON F-21 (both Orient Chem. Ind. Co., Ltd.)
- Metal-containing azo complex, such as BONTRON S-34, BONTRON S-44 (both Orient Chem. Ind. Co., Ltd.), and T-95, TRH (Hodogaya Chem. Ind. Co., Ltd.)

Group B

- Quaternary ammonium, such as BONTRON P-51 (Orient Chem. Ind. Co., Ltd.) and TP-415 (Hodogaya Chem. Ind. Co., Ltd.)

Azine compound such as BONTRON N-01, BONTRON N-04, and BONTRON N-07 (all Orient Chem. Ind. Co., Ltd.)

Triphenylmethane derivatives such as Blue PR (Hoechst Corp.) Concretely,

When the amount of electrification of (+) toner is increased, an electric charge-controlling agent in the group A is used.

When the amount of electrification of (+) toner is decreased, an electric charge-controlling agent in the group B is used.

When the amount of electrification of (−) toner is increased, an electric charge-controlling agent in the group B is used.

When the amount of electrification of (−) toner is decreased, an electric charge-controlling agent in the group A is used.

(3) Thickness

Figure 2:
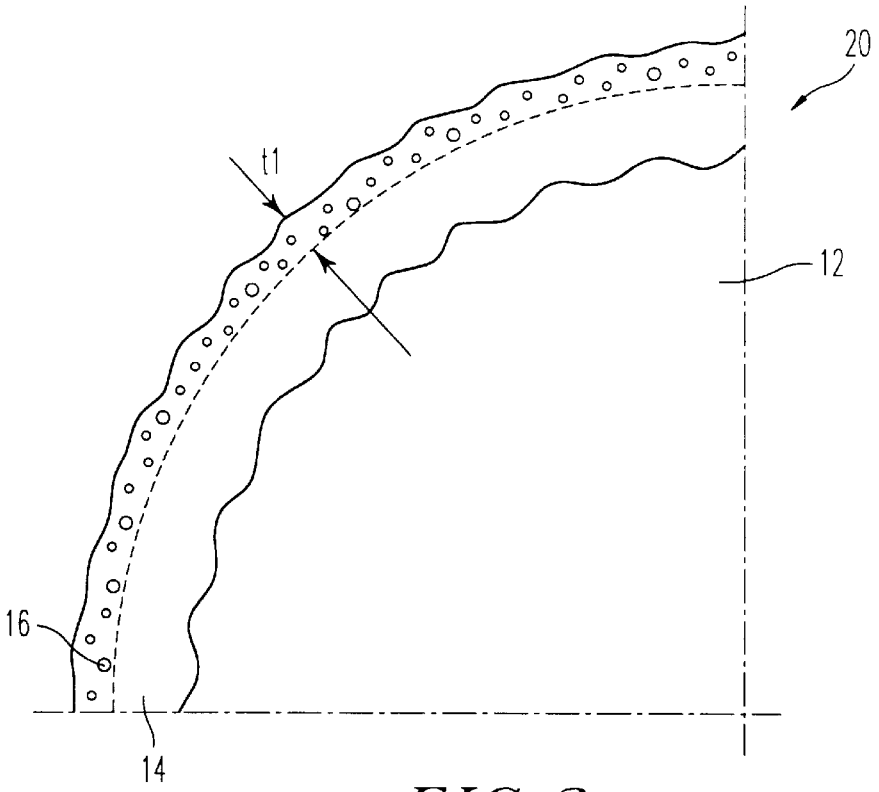
FIG. 2 is a figure for explaining a thickness of a particle layer having an ability to control an electric charge.

A thickness of a particle layer having an ability to control an electric charge is defined as a thickness where such electric charge-controlling particles are embeded and existing in the polyethylene covering layer, namely "t1" as shown in FIG. 2 illustrating a part of a carrier.

Figure 3:
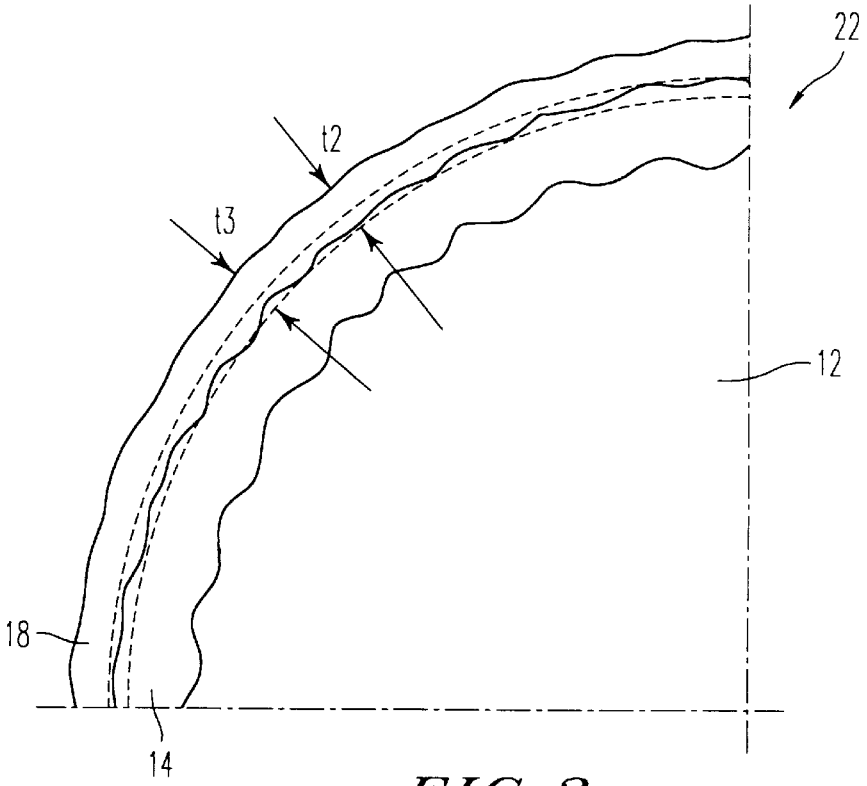
FIG. 3 is a figure for explaining a thickness of a resin layer having an ability to control an electric charge.
Figure 4:
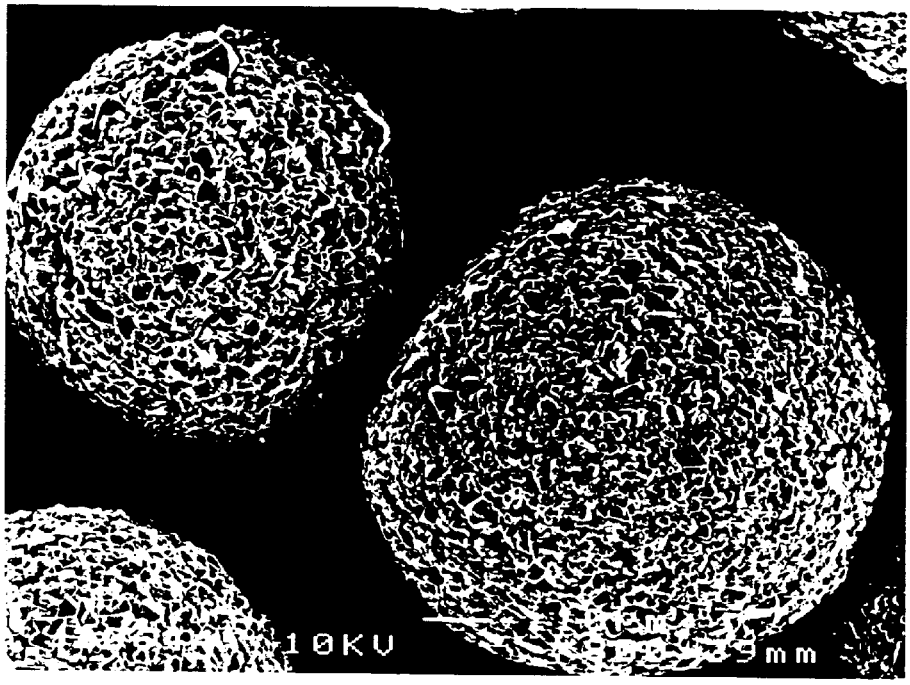
FIGS. 4 and 5 are photos for showing a carrier core material having an uneven surface.

A thickness of a resin layer having an ability to control an electric charge, is also defined as a total thickness of a region where such an electric charge-controlling resin is existing in the polyethylene covering layer and a thickness "t3" where a part of such resin penetrates into the polyethylene covering layer. Thus, the thickness of a resin layer having an ability to control an electric charge, imply for the thickness of "t2" as shown in FIG. 3.

Note that such thickness of a particle layer having an ability to control an electric charge and thickness of a resin layer having an ability to control an electric charge (sometimes called as a thickness of an electric charge-controlling layer) are respectively measured by the SEM observance(SEM photo). Thus, after eliminating the magnetic core material with conc. HCl/ethanol (10 wt. %/90 wt. %) solution and encapsulating the eliminated carrier with an epoxy resin under a reduced pressure condition, the carrier was cut by using a microtome to reveal its section. Then, the thickness at 16 points of its section were measured and averaged as a thickness of an electric charge-controlling layer.

Next, the reason why the thickness of an electric charge-controlling layer should be restricted within a range of 0.01–2 $\mu$m will be explained. If such thickness is below 0.01 $\mu$m, the intended surface-improving effect, namely the improvement of the electrification amount, may not be obtained. If such thickness is higher than 2 $\mu$m, an electric charge-controlling layer tends to exfoliate from the polyethylene covering layer and gives low durability.

Therefore, to obtain the good balance between the electric charge-controlling ability and the durability, the thickness of an electric charge-controlling layer preferably should be restricted within a range of 0.03–1.5 $\mu$m, more preferably should be restricted within a range of 0.05–1.0 $\mu$m.

(4) Formation and fixation of resin/particle layer having electric charge-controlling ability The formation and fixation of resin/particle layer having an electric charge-controlling ability according to the present invention, is carried out by one of the following three methods or by combining them, depending on the properties such as particle size, solubility against organic solvent, melting point, and hardness of the resin or electric charge-controlling agent used.

This is because the carrier having a polyethylene-coated layer obtained through the direct polymerization method is not sufficient in its electrification characteristics and thus is required to improve its electric charge-controlling ability although such a carrier has a good durability.

On the other hand, the polyethylene-coated layer obtained through the direct polymerization method tends to have convexes and concaves on its surface. It is difficult, however, for such a layer to be uniformly fixed onto the surface of the polyethylene-coated layer even after some electric charge-controlling particles and the like are added.

Therefore, if the following processing methods are employed, it is possible to obtain an electric charge-controlling layer having a predetermined thickness for uniformly fixing the electric charge-controlling particles and the like and thus improving its electrification characteristics even when convexes and concaves exist on the surface of the polyethylene-coated layer.

1) Fixation by Mechanical Impact (Process by Mechanical Impact)

The Process by Mechanical Impact can be defined as such a method wherein the carrier having a polyethylene-coated layer is rotated with a high angular velocity (for example, the velocity of the tip of the rotor is 10–40 m/sec, or more preferably, 15–30 m/sec) so that the electric charge-controlling particles are fixed onto the carrier by the shearing stress due to the impact and frictional forces caused by the collisions between the particles or with the rotor and tank walls, thereby forming the electric charge-controlling layer.

Thus, in actually performing the process by mechanical impact, the electric charge-controlled layer is preferably formed by the steps of mixing a carrier and an appropriate amount of a resin or electric charge-controlling particles so as to have the electric charge-controlling particles attached onto the surface and then adding more mechanical impact force by using a crushing machine such as a Henshel mixer FM10L (Mitsui Miike Chem. Eng. Machine Co., Ltd.) so that the electric charge-controlling particles will be embedded into the polyethylene-coated layer.

In adding the mechanical impact force, the optimal condition (wherein neither the coated layer nor the core material is destroyed, thereby efficiently fixing the particles and the like) differs depending upon the shape of the rotor, processing time, temperature, the amount to be processed and the amount of the agent. Therefore, such a condition may be suitably adjusted.

For example, the amount of the resin and electric charge-controlling agent to be added in adding the mechanical impact force is preferably decided in accordance with the absolute value of the amount of electrification to be changed. Although the treatment time depends on the amount of the resin and electric charge-controlling agent to be added, the amount of the high-molecular-weight polyethylene and other factors, the duration of 0.5–5 hours is preferred. Further, since dusts such as resin particles are generated during the fixation of the resin and electric charge-controlling agent by this mechanical impact, additional classification must be carried out adequately.

2) Thermal Fixation by Heating (Fixation Process by Heating)

The Fixation Process by Heating can be represented by the thermal spheronization treatment. This thermal spheronization treatment can be defined as a one-pass (one-through) treatment method wherein the carriers with polyethylene-coated layer dispersed in a gas stream will be instantaneously heated up to a temperature that is higher than the melting point of the polyethylene resin and then instantaneously cooled down to the temperature that is lower than the melting point of the polyethylene resin so that the carrier with the fixed electric charge-controlling particles will be collected. That is, such a one-pass (one-through) treatment method is preferred if the carrier is to be collected as in a not aggregated condition.

The above-mentioned definition of the Fixation Process by Heating does not include supiller coater treatment wherein a solution is sprayed and then heated while being convected in a batch process.

In order to perform a fixation process by heating, a thermal spheronizing machine (Hosokawa Micron Co., Ltd.) is used. Then, a carrier with polyethylene-coated layer is mixed with an appropriate amount of resin and electric charge-controlling agent. After mixing these, the resultant material will be heated during less than 2 seconds or more preferably during less than 1 second but during the time sufficient for the polyethylene to melt. Then, the material will instantaneously cooled down to the room temperature such as 25–30 degrees centigrade. This cooling time should be less than 2 seconds or more preferably less than 1 second but the time sufficient for the material to go back to the temperature less than the polyethylene's melting point.

The amount of the resin and electric charge-controlling agent to be added in this treatment depends on the absolute value of the amount of electrification to be changed.

Further, in the thermal spheronization treatment, it is necessary to keep the resin and electric charge-controlling agent uniformly attached to the surface of the carrier before the treatment. For this purpose, a mixing treatment such as the ball mill treatment, the V-blender treatment, and the Henshel-mixer treatment (for about 1 min) is preferably carried out to electrostatically or mechanically attach the particles of the resin and electric charge-controlling agent onto the surface of the carrier. Thus, a fixed electric charge-controlled layer is formed by instantaneously heating with uniformly attaching onto the surface of the carrier.

3) Wet-type Fixation (Wet Treatment)

The Wet Treatment is defined as a method wherein a resin or an electric charge-controlling agent is dissolved in an appropriate organic solvent (which dissolves the added resin and volatile), then adding carriers to the resultant solution and heating it while sufficiently stirring it, thereby evaporating and eliminating the organic solvent so as to fixing the resulting material.

Such a wet treatment is preferably carried out by mixing the polyethylene-coated carrier and an appropriate amount of the resin or electric charge-controlling agent using a machine, which carries out wet-type coating, such as a Universal Mixing/Stirring Machine 5DMV-01-r (Dalton Co., Ltd.).

The polyethylene-coated layer obtained via the direct polymerization method has on its surface convexes and concaves the sizes of which are a few $\mu$m. If such a layer is provided with a solution including a resin capable of controlling electrical charges, such covering resin will not readily peel off the surface because the covering resin has gone into the polyethylene-coated layer. Further, by performing the above-mentioned fixation treatment by heating, the resin is fixed in such a manner that the polyethylene-coated layer is partially into the surface, thereby readily forming a resin layer the electrical charge-controlling capacity of which is the thickness of 0.01–2 $\mu$m.

The amount of the resin and electric charge-controlling agent to be added during this treatment depends on the absolute value of the amount of electrification to be changed. In this treatment, heating at 30–40° C. is carried out to prevent a temperature drop caused by evaporation of a solvent.

4. Electroconductivity of carrier

Although the optimal electroconductivity of a carrier depends on the-system of the developing agent in which the carrier is used, a preferable value is $1\times10^{2}$–$1\times10^{14}$ ($\Omega\cdot$cm) in general.

If the value is lower than $1\times10^{2}$ ($\Omega\cdot$cm), carrier development may occur. If the value is higher than $1\times10^{14}$ ($\Omega\cdot$cm), deterioration in the quality of image such as lowering of the image density may occur.

II. Developing Agent for Electrophotography

The developing agent for electrophotography according to the present invention will be obtained by mixing various toners with the above-mentioned carrier.

1. Toner

As a toner according to the present invention, the toner, which was produced according to well-known methods such as the suspension polymerization method, the crushing method, the encapsulating method, the spray dry method, and the mechanochemical method, will be used, and usually binder resins, coloring agents, and other additives such as electric charge-controlling agents, lubricants, off-set-preventing agents, and fixation-enhancing agents can also be formulated if necessary. A magnetic toner, which has an improved developing property and prevent scattering of the toner in the machine, will also be produced by adding a magnetic material. In addition, fluidizing agents will also be added to improve its fluidizability. Binder resins which will be used are polystyrene-based resins such as polystyrene, styrene/butadiene copolymer, and styrene/acryl copolymer; ethylene-based copolymers such as polyethylene, ethylene/vinyl acetate copolymer, and ethylene/vinyl alcohol copolymer; epoxy-based resins; phenol-based resins; acryl phthalate resin; polyamide resin; polyester-based resins; and maleic acid resin. Coloring agents which will be used are well known dyes/pigments such as carbon black, Copper Phthalocyanine Blue, Indus Melia Blue, Peacock Blue, Permanent Red, Red Oxide, Alizarin lake, Chrome Green, Malachite Green lake, Methyl Violet lake, Hansa Yellow, Permanent Yellow, and titanium oxide. Electric charge-controlling agents which will be used are positive electric charge-controlling agents such as nigrosin, nigrosin base, triphenylmethane-based compounds, polyvinylpyridine, and quaternary ammonium salt; and negative electric charge-controlling agents such as metal-complexes of alkyl-substituted salicylic acid (e.g. a chromium complex or a zinc complex of di-tert-butylsalicylic acid). Lubricants which will be used are Teflon(polytetorafuluoroethylene), zinc stearate, and polyfluorovinylidene. Off-set-preventing/fixation-enhancing agents which will be used are a polyolef in wax or the like such as low-molecular-weight polypropylene and its modification. Magnetic materials which will be used are magnetite, ferrite, iron, and nickel. Fluidizing agents which will be used are silica, titanium oxide, aluminum oxide, or the like.

The average size of the toner is preferably lower than 20 $\mu$m, more preferably in the range of 5–15 $\mu$m.

2. Mixing ratio

The weight ratio of toner/carrier according to the present invention should be in the range of 2–20 wt. %, preferably 3–15 wt. %, more preferably 4–12 wt. %. If the ratio is lower than 2 wt. %, the amount of toner electrification may become high, and enough image density is not given. If the ratio is higher than 20 wt. %, enough amount of electrification may not be obtained, and the toner scatters from the developing machine and pollutes inside the copying machine, or causes toner-overlapping.

3. Usage

The developing agent according to the present invention is used in the so-called 2-component-type and 1.5-component-type electrophotography system such as the copying machine (analogue, digital, monochrome, and color type), the printer (monochrome and color type), and the facsimile, especially most suitably in the high-speed/ultra-high-speed copying machine and printer or the like in which the stress applied to the developing agent is high in the developing machine. There is no special limitation for the type of image-formation, the type of exposure, the type (apparatus) of development, and various types of control (e.g. the type of controlling the density of a toner in a developing machine). One can adjust it to an optimal resistance, a particle size/particle size distribution, a magnetic power, and an amount of electrification of the carrier and the toner, depending on the system.

EXAMPLES

The examples of the present invention are described further concretely below.

[Production of Carrier]

(1) Preparation of titanium-containing catalytic component

Into a 500-ml flask whose atmosphere was replaced for argon, 200 ml of dried n-heptane and 15 g (25 mmol) of magnesium stearate that had been dried at 120° C. under a reduced pressure (2 mmHg) were added at room temperature to make a slurry. After 0.44 g (2.3 mmol) of titanium tetrachloride was dropwisely added with stirring, the content began to be heated, the reaction was carried out under reflux for 1 hour, and a clear viscous solution of a titanium-containing catalyst (the active catalyst) was obtained.

(2) Evaluation of activity of titanium-containing catalytic component

Into a 1-liter autoclave whose atmosphere was replaced for argon, 400 ml of dried hexane, 0.8 mmol of triethylaluminum, 0.8 mmol of diethylaluminun chloride, and 0.004 mmol (as titanium atom) of the titanium-containing catalytic component obtained in (1) were added, and the content was heated up to 90° C., wherein the inner pressure of the system was 1.5 kg/cm$^2$G. After hydrogen was supplied up to 5.5 kg/cm$^2$G, ethylene was continuously supplied keeping the total pressure at 9.5 kg/cm$^2$G. Polymerization was carried out for 1 hour, giving 70 g of polymer. The polymerization activity was 365 kg/g·Ti/Hr, and MFR (melt flow rate at 190° C., a loading of 2.16 kg according to JIS K 7210) of the polymer obtained was 40 g/min.

(3) Production of polyethylene-coated carrier

Figure 5:
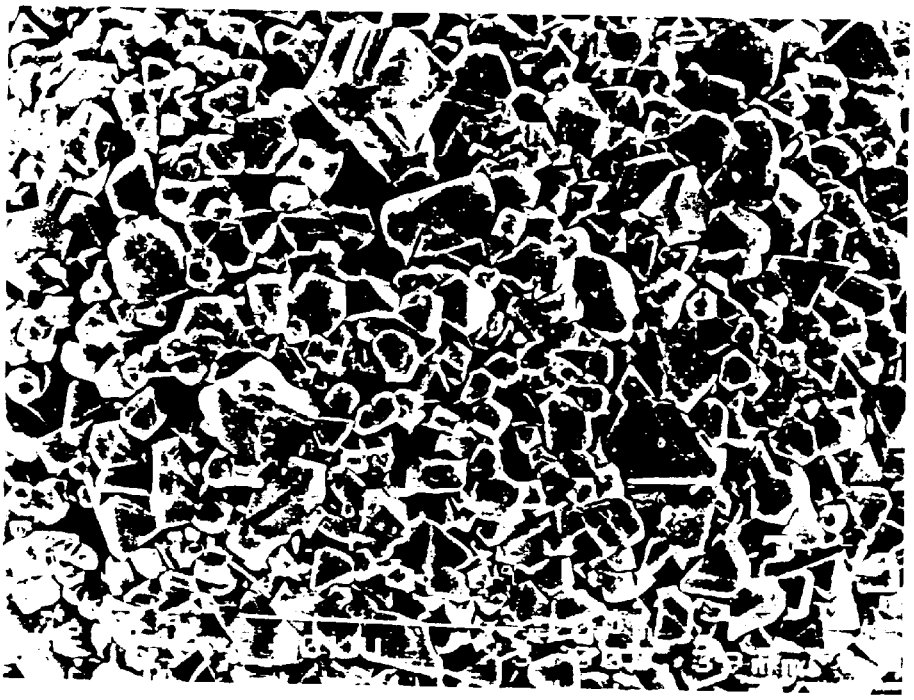
Figure 6:
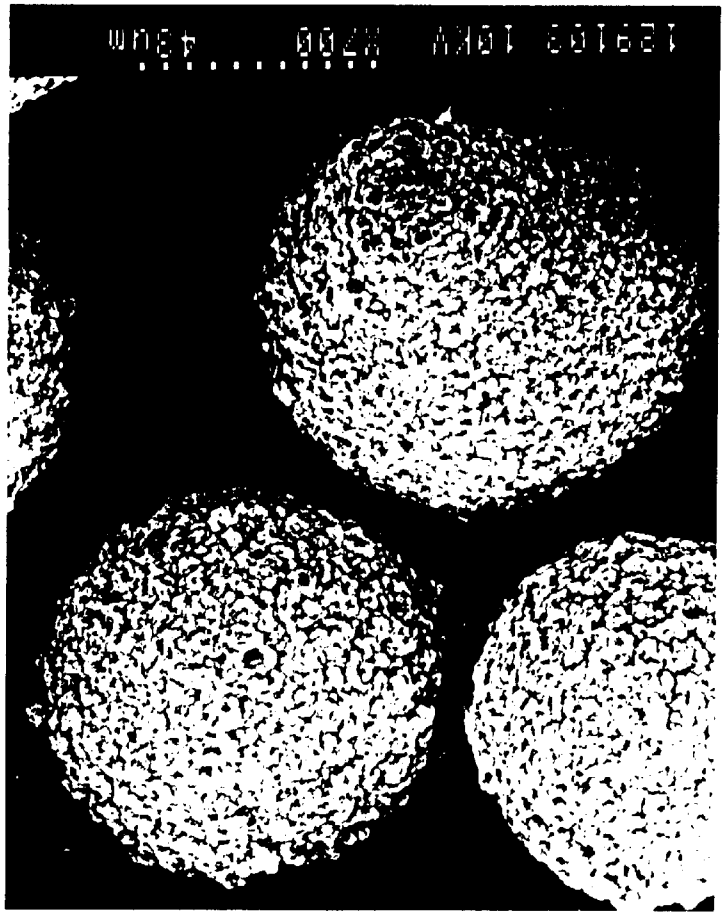
FIGS. 6 and 7 are photos for showing a carrier (carrier A) having an uneven surface which is obtained by directly polymerization method.

Into a 2-liter autoclave whose atmosphere was replaced for argon, 960 g of sintered ferrite powder F-300 (Powder Tech Corp., average particle size 50 $\mu$m) as shown in FIGS. 5 and 6 was added, the content was heated up to 80° C., and drying was carried out under a reduced pressure (10 mmHg) for 1 hour. After the content was cooled down to 40° C., 800 ml of dried hexane was added, and mixing was started. After 5.0 mmol of diethylaluminum chloride and the titanium-containing catalytic component described in (1) (0.05 mmol as titanium atom) were added, reaction was carried out for 30 min. Then the content was heated up to 90° C., 4 g of ethylene was introduced, the inner pressure being 3.0 kg/cm$^2$G. After hydrogen was supplied up to 3.2 kg/cm$^2$G, 5.0 mmol of triethylaluminum was added to start polymerization. The inner pressure of the system went down to and was stabilized at 2.3 kg/cm$^2$G in about 5 min. Then a slurry containing 5.5 g of carbon black (Mitsubishi Chem. Co., Ltd., MA-100) in 100 ml of dried hexane was added, polymerization was carried out continuously supplying ethylene keeping the inner pressure at 4.3 kg/cm$^2$G for 45 min (the supply was stopped when 40 g of ethylene was introduced into the system), and 1005.5 g of carbon black-containing polyethylene resin-coated ferrite was obtained. Died powder of it was uniformly black. Electron microscopic observation revealed that the surface of the ferrite was covered with a thin polyethylene layer and the carbon black is uniformly dispersed in the polyethylene layer. TGA (Thermal gravimetric analyzer) of the composite revealed that the ratio of ferrite/carbon black/polyethylene was 95.5/0.5/4.0 by weight.

Figure 7:
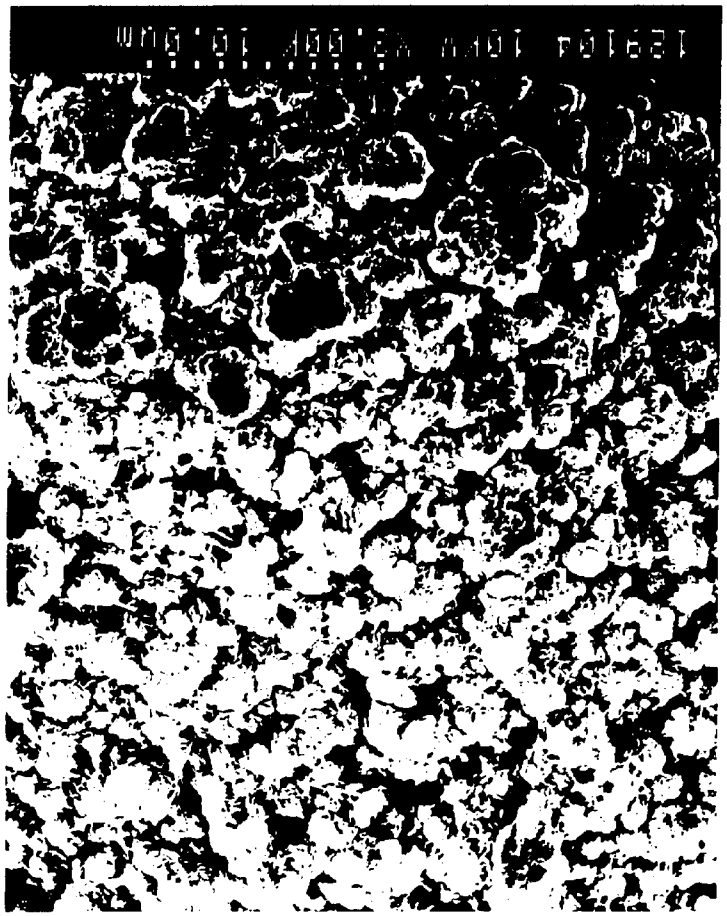
Figure 8:
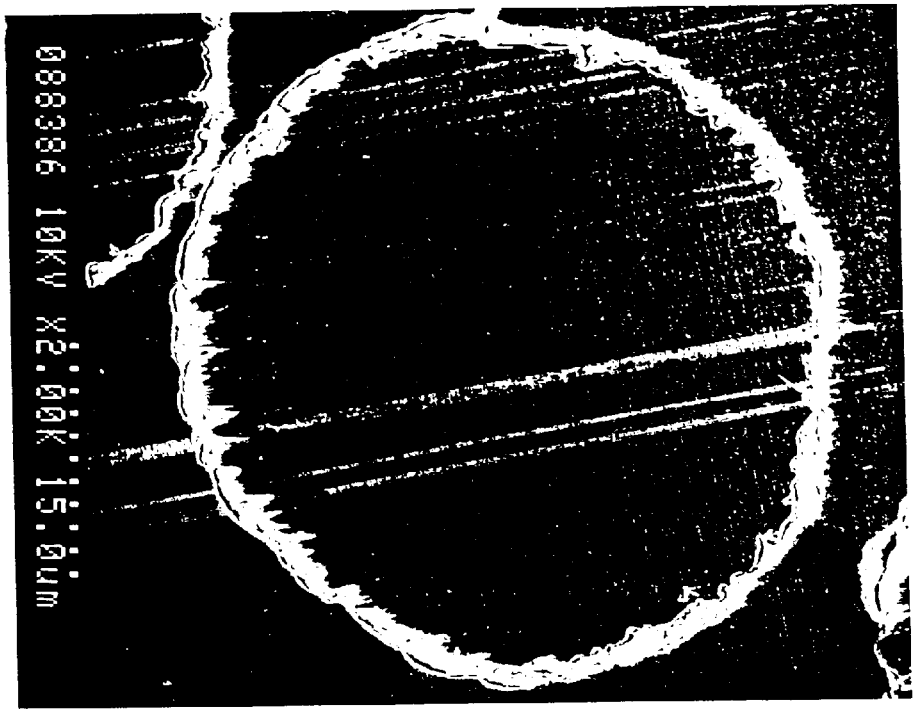
FIGS. 8 and 9 are sectional photo-views of a carrier (carrier A) as shown in FIGS. 6 and 7.
Figure 9:
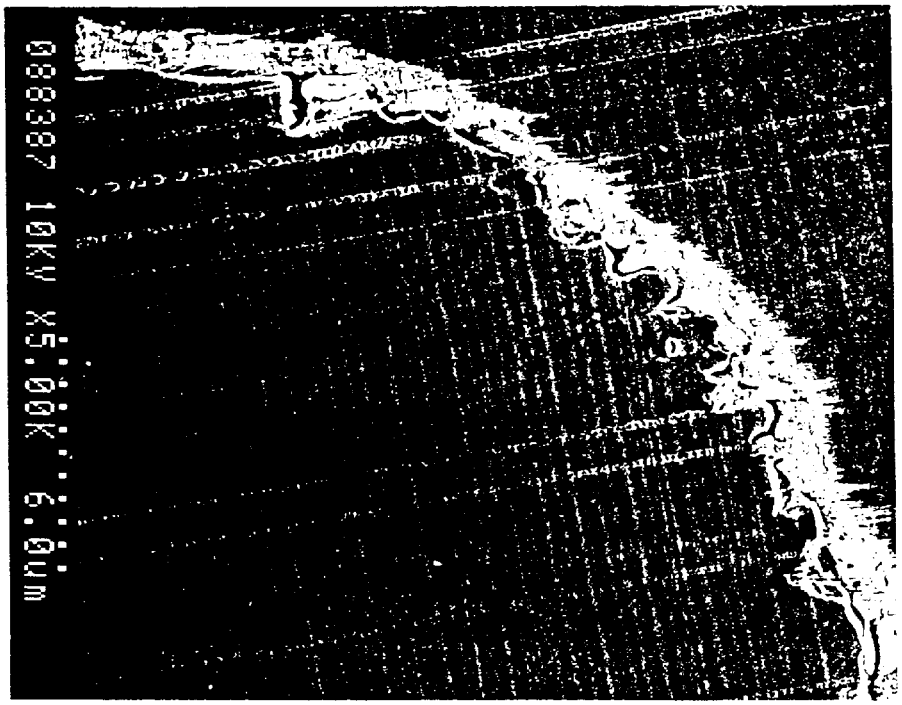
Figure 10:
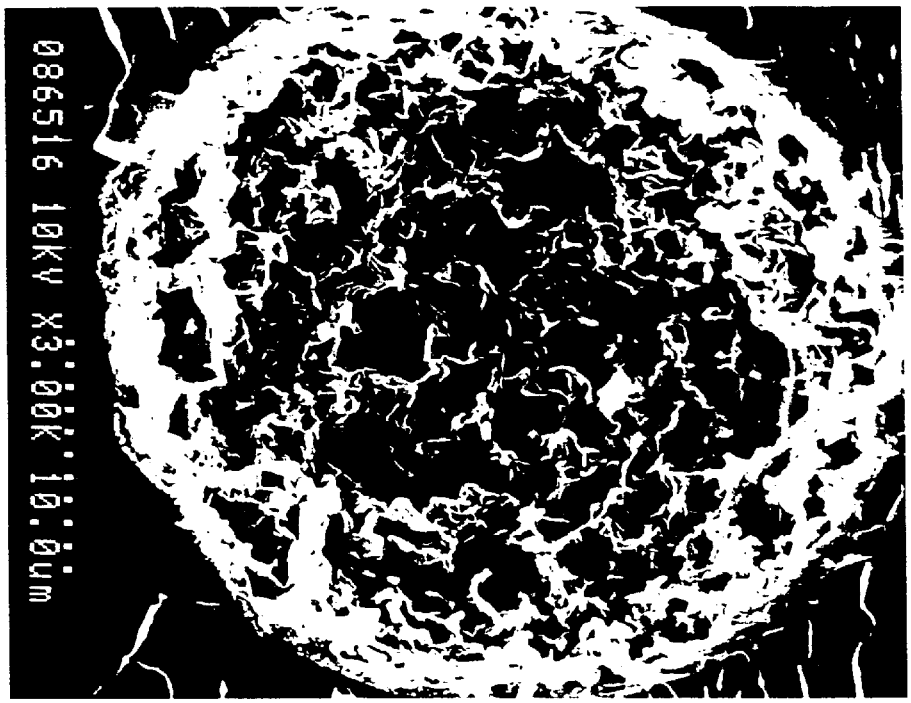
FIGS. 10 and 11 also are sectional photo-views of a carrier (carrier A) as shown in FIGS. 6 and 7.
Figure 11:
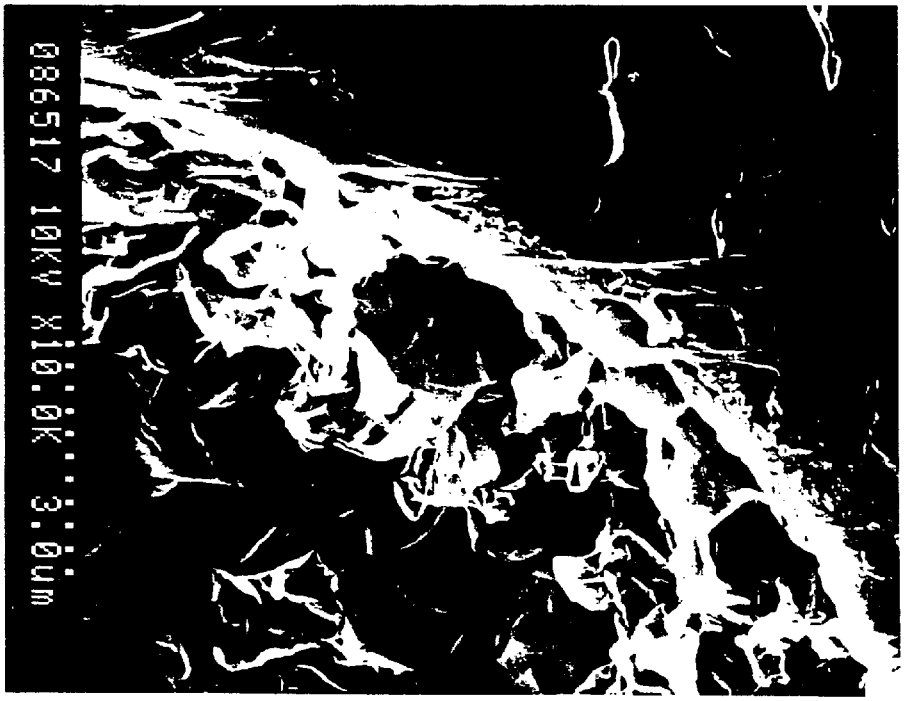
Figure 12:
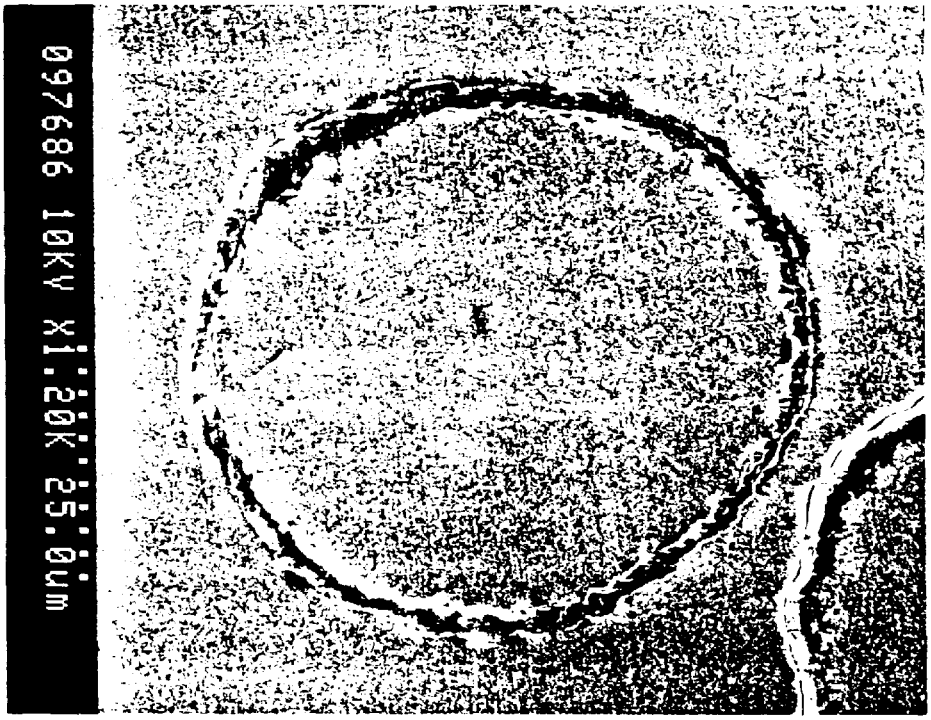
FIGS. 12 and 13 are sectional photo-views of a carrier (carrier D) of an example 3.

The intermediate-step carrier having an uneven surface obtained through this step are shown in FIGS. 7 and 8, and are designated as "the carrier A". The weight-average molecular weight of the coating polyethylene was 206,000.

Example 1

Into a 5-liter universal mixer/stirrer machine (Dalton Co., Ltd., 5DMV-01-r), 1000 g of the carrier A and a solution containing 4.0 g of a fluorine-based resin (Daikin Ind. Co., Ltd., fluorovinylidene VT100) as the electric charge-controlling agent in 150 ml of acetone were added. Then a fluorine-based resin coat was formed on the carrier A by evaporating the solvent with stirring. Then to remove aggregated crude powder, large particle size carrier and aggregated resin were removed using a sieve. In addition, to remove uncoated particles or the like, treatment was carried out using a fluidized-bed type gas-flow classifier at a linear velocity of 20 cm for 2 hours.

Thus, the carrier B was obtained in this way and after eliminating the magnetic core material and encapsulating the eliminated carrier with an epoxy resin under a reduced pressure condition, the carrier was cut by using a microtome to reveal its section. Then, its section was observed by SEM. The fluorine-based resin layer was confirmed that a part of such layer penetrated into the polyethylene layer and its thickness was 0.18 $\mu$m.

Example 2

Into a 10-liter Henshel mixer (Mitsui Miike Co., Ltd., FM10L), 1000 g of the carrier A and 45 g of a phenol-based resin (Orient Chem. Ind. Co., Ltd., E-84) as the electric charge-controlling agent were added. Then an electric charge-controlling layer of phenol-based resin was formed on the carrier A by mixing using the Henshel mixer to give mechanical impact for 1 hour. To remove the excess electric charge-controlling agent existing unfixed freely, the large particle size carrier and the aggregated electric charge-controlling agent were removed using a sieve. In addition, to remove particles such as the unfixed electric charge-controlling agent, treatment was carried out using a fluidized-bed type gas-flow classifier at a linear velocity of 20 cm for 2 hours.

Thus, the carrier C was obtained in this way and its section obtained by using a same method as example 1, was observed by SEM. The phenol-based resin layer was confirmed that it is embeded perfectly into the polyethylene layer and its thickness was 1.99 $\mu$m.

Example 3

Into a 10-liter Henshel mixer (Mitsui Miiuke Co., Ltd., FM10L), 1000 g of the carrier A and 1.0 g of a metal-containing azo complex (Hodogaya Chem. Ind. Co., Ltd., T-95) as an electric charge-controlling agent. Then the content was mixed using the mixer to attach it electrostatically or mechanically onto the surface of the carrier A for 1 min. Then heating was carried out by the hot wind at 200° C. using a heat spheronizing machine (Hosokawa Micron Co., Ltd., Heat Spheronizing Apparatus) to melt/fix the electric charge-controlling agent in the coated polyethylene resin and to form an electric charge-controlling layer of a metal-containing azo complex on the carrier A. To remove the excess electric charge-controlling agent existing unfixed freely, the large particle size carrier and the aggregated electric charge-controlling agent were removed using a sieve. In addition, to remove particles such as the unfixed electric charge-controlling agent, treatment was carried out using a fluidized-bed type gas-flow classifier at a linear velocity of 20 cm for 2 hours.

Figure 13:
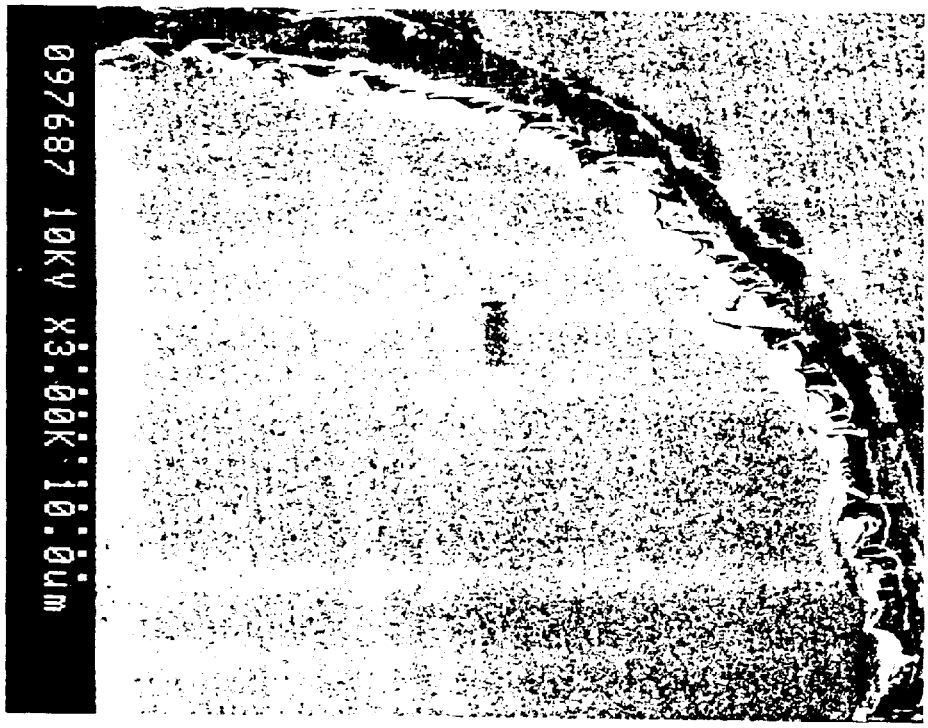

Thus, the carrier D was obtained in this way and its section obtained by using a same method as example 1, was observed by SEM as shown in FIGS. 13 and 14. The metal-containing azo complex was confirmed that it is embeded perfectly into the polyethylene layer and its thickness was 0.55 μm.

Example 4

Into a 5-liter universal mixer/stirrer machine (Dalton Co., Ltd., 5DMV-01-r), 1000 g of the carrier A and a solution containing 2.0 g of a fluorine-based resin (Daikin Ind. Co., Ltd., fluorovinylidene VT100) as an electric charge-controlling agent in 150 ml of acetone. Then a fluorine-based resin coat was formed on the carrier A by evaporating the solvent with stirring. Then by giving mechanical impact by mixing using a Henshel mixer for 1 hour, the electric charge-controlling layer was made smooth and the electric charge-controlling layer formed was made stronger. To remove the excess crude powder existing unfixed freely, the large particle size carrier and the aggregated resin were removed using a sieve. In addition, to remove unfixed resin particles or the like, the treatment was carried out by using a fluidized-bed type gas-flow classifier at a linear velocity of 20 cm for 2 hours.

Thus, the carrier E was obtained in this way and its section obtained by using a same method as example 1, was observed by SEM. The fluorine-based resin layer was confirmed that a part of such layer penetrated into the polyethylene layer and its thickness was 0.09 μm.

Example 5

Into a 5-liter universal mixer/stirrer machine (Dalton Co., Ltd., 5DMV-01-r), 1000 g of the carrier A and a solution containing 25 g of a silicone-based resin (Shin-Etsu Chem. Ind. Co., Ltd., Silicone Varnish KBM-7103) as an electric charge-controlling agent in methanol. Then a silicone-based resin coat was formed on the carrier A by evaporating the solvent with stirring. Then to remove aggregated crude powder, the large particle size carrier and the aggregated resin were removed using a sieve. In addition, to remove uncoated particles or the like, treatment was carried out using a fluidized-bed type gas-flow classifier at a linear velocity of 20 cm for 2 hours.

Thus, the carrier F was obtained in this way and its section obtained by by using a same method as example 1, was observed by SEM. The silicone-based resin layer was confirmed that a part of such layer penetrated into the polyethylene layer and its thickness was 1.1 μm.

Applied Example 1

Each amount of electrification was determined, with respect to the toners A–D with respect to each of the carriers A–F obtained in the examples for production of the carriers and Examples 1–5, using an electrification amount-measuring machine (Toshiba Chem. Co., Ltd., TB-500). The Measurement was carried out by mixing 0.5 g of each toner and 9.5 g of each toner (called as T/C=5) using a ball mill in a 50-ml synthetic resin bottle for 1 hour, at a blow pressure of 0.8 kg/cm$^2$, for a blow time of 50 sec using a 500-mesh stainless steel net. Each value of the amount of electrification determined are summarized in Table 1.

Toner A:

Stylene/n-butylmethacrylate copolymer resin 100 wt. parts

Carbon black (Mitsubishi Chem. Co., Ltd., MA#8) 5 wt.parts

Dye (Orient Chem. Ind. Co., Ltd., N07) 5 wt. parts

The toner A was obtained by adequately mixing the above materials using a ball mill, blending using three rolls heated at 140° C., cooling the mixture by standing, and roughly crushing using a feather mill, and further finely crushing using a jet mill.

Toner B:

Bisphenol A-based polyester resin 100 wt. parts

Carbon black (Cabot Corp., BPL) 8 wt. parts

Dye (Orient Chem. Ind. Co., Ltd., E-84) 5 wt. parts

The toner B was obtained by adequately mixing the above materials using a ball mill, blending using three rolls heated at 140° C., cooling the mixture by standing, and roughly crushing using a feather mill, and further finely crushing using a jet mill.

Toner C:

Stylene/n-butylmethacrylate copolymer resin 100 wt. parts

Carbon black (Mitsubishi Chem. Co., Ltd., MA#8) 5 wt. parts

Dye (Hodogaya Chem. Ind. Co., Ltd., TRH) 5 wt. parts

The toner C was obtained by adequately mixing the above materials using a ball mill, blending using three rolls heated at 140° C., cooling the mixture by standing, and roughly crushing using a feather mill, and further finely crushing using a jet mill.

Toner D:

Stylene/n-butylmethacrylate copolymer resin 100 wt. parts

Carbon black (Mitsubishi Chem. Co., Ltd., MA#8) 5 wt.parts

Dye (Orient Chem. Ind. Co., Ltd., E-89) 4 wt. parts

The toner D was obtained by adequately mixing the above materials using a ball mill, blending using three rolls heated at 140° C., cooling the mixture by standing, and roughly crushing using a feather mill, and further finely crushing using a jet mill.

As a result, it was found that each amount of electrification was not enough with respect to a developing agent of carrier A in the combination with the toners A–D, namely the electrification was out of the range of ±18–30 μC/g that is ordinary required in an electro-photographic printing machine.

On the contrary, it was found that the amount of electrification was enough with respect to at least one of developing agents of the presented carrier B–F of example 1–5, in the combination with the toners A–D, namely the electrification at least one of the developing agent can be controllable within the range of ±18–30 μC/g.

Also, depending on the kind of an polarity of a toner which is combined with a carrier, the developing agents according to the each carrier of example 1 and 4, in the combination with the toners A and D can remarkably increase the amount of positively electrification and the developing agents according to the each carrier of example 2, 3 and 5, in the combination with the toners B and C can remarkably increase the amount of negatively electrification.

Application Example 2

Easiness of electrification was compared between the carrier A (comparative example 1) and the carrier B (example 1) after the coat treatment. This comparison was made by measuring the change of the amount of electrification with respect to the carrier A and B in combination with the toner A by stirring time (stirring using a ball mill) before measurement of the amount of electrification. The comparison revealed that the carrier B having the resin coat was excellent in the initial amount of electrification and stability thereafter. Such initial rise of the amount of electrification influences stability of the image. This result is illustrated in FIG. 1.

Comparative Example 1

Amount of electrification of each toner with respect to the carrier A before the electric charge control treatment, which was obtained in the examples for production of the carriers, was determined in a similar manner as Application Example 1. The result is summarized in Table 1.

Comparative Example 2

Into a 10-liter Henshel mixer (Mitsui Miiuke Co., Ltd., FM10L), 1000 g of the carrier A, an electric charge controlling agent, and 50 g of phenol-based resin (Orient Chem. Ind. Co., Ltd., E-84) were admixed. Then an electric charge-controlling layer was formed on the carrier A by giving mechanical impact by mixing using the Henshel mixer for 1 hour. To remove the electric charge-controlling agent existing unfixed freely, the large particle carrier and the aggregated electric charge-controlling agent were removed using a sieve. In addition, to remove unfixed electric charge-controlling agent or the like, treatment was carried out using a fluidized-bed type gas-flow classifier at a linear velocity of 20 cm for 2 hours. Thus the carrier G was obtained, having a thickness of the phenol-based resin layer of 2.5 μm.

1 kg of a developing agent was prepared by mixing the carrier G and the toner B at a weight ratio of 95/5. Durability of this developing agent was evaluated by copying 1,000 times using a commercial medium-speed copying machine (Fuji Xerox Co. Lt., 5039) (40 sheet/min, A4). As a result, stains in image occurred since the early stage of the evaluation of durability of copying, and the stains grew worse with the number of the copies. The reason for the stains was exfoliation of the phenol-based resin.

Comparative Example 3

Into a 5-liter universal mixer/stirrer (Dalton Co., Ltd., 5DMV-01-r), 1000 g of the carrier A and a solution containing 0.2 g of a fluorine-based resin (Daikin Ind. Co., Ltd., Fluorovinylidene VT100) as an electric charge-controlling agent in 150 ml of acetone were added. Then a fluorine-based resin coat was formed on the carrier A by evaporating the solvent with stirring. Then in order to remove aggregated crude powder, large particle size carrier and aggregated resin were removed using a sieve. In addition, in order to remove uncoated particles or the like, treatment was carried out using a fluidized-bed type gas-flow classifier at a linear velocity of 20 cm for 2 hours. Thus the carrier H was obtained, having a thickness of the fluorine-based resin layer of 0.008 μm.

TABLE 1

| Example/ Comparative Example | Carrier Type | Thickness (μm) | Toner A (Mc/g) | Toner B (μC/g) | Toner C (μC/g) | Toner D (μC/g) |
|---|---|---|---|---|---|---|
| Comparative Example 1 | A | 0 | +13.6 | −8.7 | −2.0 | +5.2 |
| Example 1 | B | 0.18 | +19.8 Very Good | −5.1 Bad | −0.8 Bad | +16.6 Good |
| Example 2 | C | 1.99 | +10.4 Bad | −19.2 Very Good | −8.3 Good | +1.8 Bad |
| Example 3 | D | 0.05 | +11.3 Bad | −21.0 Very Good | −14.7 Good | +2.7 Bad |
| Example 4 | E | 0.09 | +23.2 Very Good | −2.3 Bad | −0.5 Bad | +18.4 Very Good |
| Example 5 | F | 1.1 | −5.7 Bad | −35.0 Very Good | −28.7 Very Good | −6.7 Bad |
| Comparative Example 2 | G | 2.5 | +10.6 Bad | −19.6 Very Good | −8.5 Good | +1.5 Bad |
| Comparative Example 3 | H | 0.008 | +13.5 Fair | −8.7 Fair | −2.0 Fair | +4.8 Fair |

*Condition for measuring the electrification amount: T/C = 5; stirring time, 1 hour; blow pressure, 0.8 kg/cm$^2$; 50 sec; 500 mesh.
*Thickness: Thickness of an electric charge-controlling layer
*Very Good: within the range of ±18–30 μC/g
Good: improvement of ±1 μC/g or more
Fair: improvement of less than ±1 μC/g
Bad: reduction of less than ±1 μC/g Comparative Example 4

Into a solution tank of a supiller coater such as a fluidized bed/tumbling coating machine (Okada Seiko Co., Ltd. supiller coating system), 1,000 g of the sintered ferrite powder F-300, 300 ml of decaline and 10 g of a polyethylene powder were charged to prepare the polyethylene-decaline solution.

Then, thus obtained polyethylene-decaline solution was suprayed in sequence from a nozzle which was connected to the solution tank and which temperature was at 140° C., and the supiller coating was carried out for 60min. While this supiller coating, dry $N_2$was introduced into the supiller coater in order to ensure the safety in consideration of using an inflammable solvent (decaline). Until fully eliminating of the solvent by vaporization, the heating treatment in the supiller coater was carried out at 140° C., for 2 Hours to produce and recover the carrier.

As a result of this supiller coating, however, it was impossible to produce a resin-coated carrier since a polyethylene covering layer was came off (exfoliated) from the sintered ferrite surface. Also, many polyethylene powders were observed on the inside wall of the supiller coater.

Therefore, it was confirmed that a forming of a polyethylene-based resin coverage layer on the ferrite surface was impossible. Thus, the further evaluation of the carrier was stopped.

Comparative Example 5

Into a 10-liter Henshel mixer (Mitsui Miiuke Co., Ltd., FM10L), 1000 g of the carrier A was charged and mixed to for 1 hour to smooth its surface by applying a mechanical impact.

Then, into a 5-liter universal mixer/stirrer (Dalton Co., Ltd., 5DMV-01-r), the smoothed carrier A and a solution containing 4.0 g of a fluorine-based resin (Daikin Ind. Co., Ltd., Fluorovinylidene VT100) in 150 ml of acetone were charged. Afterwards, a forming of a fluorine-based resin coverage layer on the smoothed surface of carrier A was tried by agitating and solvent removing with heat. However, the carrier A and a fluorine-based resin were perfectly separated and each components was aggregated.

Therefore, it was confirmed that a forming of a fluorine-based resin coverage layer on the carrier A which was obtained by directly polymerization and which surface was smoothed, was impossible. Thus, the further evaluation of the obtained carrier was stopped.

Comparative Example 6

Into a 2-liter autoclave whose atmosphere was replaced for argon, 960 g of sintered ferrite powder F-300 (Powder Tech Corp., average particle size 50 $\mu$m) was added, the content was heated up to 80° C. Next, drying was carried out under a reduced pressure (10 mmHg) for 1 hour. Afterwards, the content was cooled down to 40° C., 800 ml of dried hexane was added, and mixing was started. After 5.0 mmol of diethylaluminum chloride and the titanium-containing catalytic component (0.05 mmol as titanium atom) were added, reaction was carried out for 30 min. Then the content was heated up to 90° C., 4 g of ethylene was introduced, the inner pressure being 3.0 kg/cm$^2$G. After hydrogen was supplied up to 3.2 kg/cm$^2$G, 5.0 mmol of triethylaluminum was added to start polymerization. The inner pressure of the system went down to and was stabilized at 2.3 kg/cm$^2$G in about 5 min. Then a slurry containing 4.0 g of silica 2000 (Nippon airosile company Co., Ltd.) as an electric charge-controlling agent was added, and polymerization was tried to carry out again while continuously supplying ethylene keeping the inner pressure at 4.3 kg/cm$^2$G. However, the inner pressure did not become low and the proceeding of polymerization was impossible.

Therefore, it was confirmed that an existing of an electric charge-controlling agent during directly polymerization inhibits its polymerization. Thus, the further evaluation of the obtained carrier was stopped.

Comparative Example 7

1,000 g of the carrier A and 10 g of a phenol-based resin (Orient Chem. Ind. Co., Ltd., BONTRON E-89) as the electric charge-controlling agent were mixed uniformly on the mixing stage and they are supplied to be fixed on the carrier by using a spiller coater at 90° C., for 40 min.

However, a phenol-based resin could not be fixed on to the polyethylene layer and many phenol-based resins were observed on the exhaust pipe, the exhaust filter and the like. Also they were observed in the polyethylene package for collecting samples. Thus, by observing the obtaind carrier by using the SEM, phenol-based resins were attaching on the surface of the carrier. Therefore, it was confirmed that an existing of an electric charge-controlling agent can not be fixed by using a spiller coater. Thus, the further evaluation of the obtained carrier was stopped.

INDUSTRIAL APPLICABILITY

As described above, the carrier for electrophotography according to the present invention is useful as the particulate carrier or the like in the two-component developing method, and the developing agent for electrophotography using the carrier is useful as the developing agent for the electrostatic latent image in various fields concerning image-formation.

What is claimed is:

1. A method for producing a carrier for electrophotography, comprising:

forming a polyethylene covering layer comprising a polyethylene resin having a weight-average molecular weight of 50,000 or more, by directly polymerizing an ethylene monomer on a surface of a catalytic treated magnetic carrier core material; and forming a particle layer having an ability to control an electric charge and having a thickness of 0.01–2 $\mu$m on a surface of the polyethylene covering layer by attaching particles to said polyethylene covering layer by a mechanical impact or a thermal fixation with heating;

thereby obtaining said carrier for electrophotography, having said magnetic carrier core material, said polyethylene covering layer;

and said particle layer on the surface of said polyethylene covering layer.

2. A method for producing a carrier for electrophotography, comprising:

forming an electroconductive layer on a surface of a magnetic carrier core;

treating said magnetic carrier core having said electroconductive layer with a catalyst, thereby obtaining a catalytically treated electroconductive layer;

forming a polyethylene covering layer comprising a polyethylene resin having a weight-average molecular weight of 50,000 or more, by directly polymerizing an ethylene monomer on a surface of said catalytically treated electroconductive layer; and forming a particle layer having an ability to control an electric charge and having a thickness of 0.01–2 $\mu$m on a surface of the polyethylene covering layer by attaching particles to said polyethylene covering layer by a mechanical impact or a thermal fixation with heating;

thereby obtaining said carrier for electrophotography, having said magnetic carrier core, said electroconductive layer; said polyethylene covering layer; and said particle layer on the surface of said polyethylene covering layer.

3. The method for producing a carrier for electrophotography according to claim 1, wherein said electroconductive layer is formed by a directly polymerizing method.

4. A method for producing a carrier for electrophotography, comprising:

forming a polyethylene covering layer having an uneven surface by directly polymerizing an ethylene monomer on a surface of a catalytic treated magnetic carrier core material;

coating a solution including a resin having an ability to control an electric charge onto a surface of the polyethylene covering layer by using a wet-treatment; and forming a resin layer having an ability to control an electric charge and having a thickness of 0.01–2 $\mu$m so that a part of a resin layer penetrates the polyethylene covering layer by heating;

thereby obtaining said carrier for electrophotography having said magnetic carrier core material, said polyethylene covering layer which comprises a polyethylene resin having a weight-average molecular weight of 50,000 or more; and said resin layer which covers the surface of said polyethylene covering layer and partly penetrates into the polyethylene covering layer.

5. A method for producing a carrier for electrophotography, comprising:

forming an electroconductive layer on a surface of a magnetic carrier core;

treating said magnetic carrier core having said electroconductive layer with a catalyst, thereby obtaining a catalytically treated electroconductive layer;

forming a polyethylene covering layer having an uneven surface by directly polymerizing an ethylene monomer on a surface of said catalytically treated electroconductive layer;

coating a solution including a resin having an ability to control an electric charge onto a surface of the polyethylene covering layer by using a wet-treatment; and forming a resin layer having an ability to control an electric charge and having a thickness of 0.01–2 $\mu$m so that a part of a resin layer penetrates the polyethylene covering layer by heating;

thereby obtaining said carrier for electrophotography having said magnetic carrier core, said electroconductive layer; said polyethylene covering layer which comprises a polyethylene resin having a weight-average molecular weight of 50,000 or more; and said resin layer which covers the surface of said polyethylene covering layer and partly penetrates into the polyethylene covering layer.

6. The method for producing a carrier for electrophotography according to claim 5, said electroconductive layer is formed by a directly polymerizing method.

7. A carrier for electrophotography having a magnetic carrier core material and a polyethylene covering layer composed of a polyethylene resin having a weight-average molecular weight of 50,000 or more, wherein the polyethylene covering layer is a layer formed by directly polymerizing an ethylene monomer on the surface of the catalytic treated carrier core material and a particle layer having an ability to control an electric charge and having a thickness of 0.01–2 $\mu$m, is formed on the surface of the polyethylene covering layer.

8. The carrier for electrophotography according to claim 7, wherein the particle having an ability to control an electric charge is fixed onto the polyethylene resin layer by a mechanical impact or a thermal fixation with heating.

9. A developing agent for electrophotography comprising a carrier for electrophotography according to claim 7, and a toner mixed with said carrier at a ratio of 2–20 wt. %.

10. A carrier for electrophotography, comprising:

a magnetic carrier core material;

an electroconductive layer formed an said carrier core material;

a polyethylene covering layer formed on said electroconductive layer and composed of a polyethylene resin with a weight-average molecular weight of 50,000 or more; and a particle layer formed on said polyethylene covering layer and having an ability to control an electric charge and having a thickness of 0.01–2 $\mu$m;

wherein said polyethylene covering layer is formed by treating said magnetic carrier core material having said electroconductive layer with a catalyst and directly polymerizing an ethylene monomer on a surface of said electroconductive layer.

11. The carrier for electrophotography according to claim 10, wherein the electroconductive layer is a layer formed by a direct polymerization method.

12. A carrier for electrophotography, having a magnetic carrier core material and a polyethylene covering layer composed of a polyethylene resin having a weight-average molecular weight of 50,000 or more; and a resin layer having an ability to control an electric charge and having a thickness of 0.01–2 $\mu$m, which covers a surface of said polyethylene covering layer and partly penetrates into the polyethylene covering layer;

wherein said polyethylene covering layer is formed by treating said magnetic carrier core material with a catalyst and directly polymerizing an ethylene monomer on a surface of said magnetic carrier core material.

13. The carrier for electrophotography according to claim 12, wherein the surface of the carrier core material is uneven.

14. A developing agent for electrophotography, comprising:

a carrier for electrophotography according to claim 12; and a toner mixed with said carrier at a ratio of 2–20 wt. %.

15. A carrier for electrophotography, comprising:

a magnetic carrier core material;

an electroconductive layer formed on said carrier core material;

a polyethylene covering layer formed on the electroconductive layer and composed of a polyethylene resin with a weight-average molecular weight of 50,000 or more; and a resin layer formed on the polyethylene covering layer and having an ability to control an electric charge and having a thickness of 0.01–2 $\mu$m;

wherein a part of said resin layer penetrates into the polyethylene covering layer;

wherein said polyethylene covering layer is formed by treating said magnetic carrier core material having said electroconductive layer with a catalyst and directly polymerizing an ethylene monomer on a surface of said electroconductive layer.

16. The carrier for electrophotography according to claim 15, wherein the electroconductive layer is formed by a direct polymerization method.

* * * * *